US005275305A

United States Patent [19]

Gross

[11] Patent Number: 5,275,305

[45] Date of Patent: Jan. 4, 1994

[54] CUP AND FLUID DISPENSER

[76] Inventor: Robert E. Gross, 22525 Adams Dr., Robertsdale, Ala. 36567

[21] Appl. No.: 945,697

[22] Filed: Sep. 16, 1992

[51] Int. Cl.[5] ..... A47F 1/14

[52] U.S. Cl. ..... 221/96; 221/199; 221/283

[58] Field of Search ..... 221/303, 221, 283, 286, 221/199, 96

[56] References Cited

U.S. PATENT DOCUMENTS

| | | | |
|---|---|---|---|
| 1,964,335 | 6/1934 | Wessman | 221/221 X |
| 2,176,232 | 10/1939 | Warren et al. | 221/283 X |
| 2,212,129 | 8/1940 | Rust | 221/283 X |
| 2,261,880 | 11/1941 | Hope | 221/303 X |
| 2,520,538 | 8/1950 | Gilbertsen | 221/199 X |
| 2,822,954 | 2/1958 | Taylor | 221/283 |
| 3,211,329 | 10/1965 | Boyd | 221/283 X |
| 3,469,739 | 9/1969 | Phillips | 221/96 |
| 3,604,592 | 9/1971 | Bacon | 221/96 |
| 3,987,932 | 10/1976 | Maldon | 221/96 |
| 4,046,284 | 9/1977 | Samuelsson | 221/283 X |

FOREIGN PATENT DOCUMENTS 849369 8/1970 Canada .

*Primary Examiner*—D. Glenn Dayoan
*Assistant Examiner*—Dean A. Reichard

[57] ABSTRACT

A refillable or disposable mouthwash and cup dispensing system incorporating a handle effect from the dispenser and cooperating with a wall mounted bracket to simplify removal and refilling. A mechanism for conserving the taps from dispensable units is disclosed.

1 Claim, 2 Drawing Sheets

CUP AND FLUID DISPENSER

BACKGROUND OF THE INVENTION

1. Prior Art

This patent relates to liquid and cup dispensers and more particularly, combination liquid and cup dispensers.

There is no threaded service caps such as those shown in the prior art which might result in a greater probability of leaks.

The prior art dispensers must be turned upside down and another service cap located on the bottom of the dispenser to gain access to the interior and spigot.

The prior art also in requires a cumbersome elongated clip to snap into place to secure cups which could also cause cups to be crushed or distorted if they were forced away from their intended seat in the concave section of the main body due to cup size change.

Similarly the prior art shows a irregularly shaped interior which would make wall mounting more difficult and would also result in a more complicated cleaning.

Mounting of this invention allows for single hand operation for cleaning and filling unlike the prior art patents.

This patent is designed to improve on the prior art to provide an easily filled and cleaned mounted dispenser for mouth wash as an example in a hospital type environment.

In order to accomplish this, a large diameter opening, such as that shown in the prior art at the top is provided with a loose fit liftoff lid so that no accessory type funnel devices would be necessary in order to refill the container. This is offset from the wall to simplify filling further.

The dispenser disclosed in this application has an offset bracket which allows for it to be easily removed, filled while the mounting stays in place and cleaned while the mounting remains in place.

2. General Discussion of the Invention

The present invention is designed in order to have a disposable or washable portion which portion is held by a mounting means to a bracket on the wall. When the user of the device needs to clean or dispose of the holder for the mouthwash or cups it can be easily removed and a separate container replaced simultaneously so that there is no need for a long period when the bracket would not have a mouthwash and cup dispenser mounted.

One of the major problems which the prior art does not address is that this invention has the ability to have disposable or easily replaced mouthwash dispenser and cup holders.

The disposal nature of these is evidenced by the fact that most mouthwash comes in disposable plastic containers initially and by adding the bracket and for the wall on a mounting mechanism cooperating with the bracket which is attached to the mouthwash container no great expense is incurred.

The containers can be glass and therefore reusable. They can also be recyclable plastic or glass.

By disposing of threaded surface caps, less capable or handicapped individuals can more easily use the invention.

Less expensive production is provided for because of the simplicity of the design.

It is therefore another object of the invention to maintain the cup supply in a totally enclosed inner chamber with an easily replaced fluid supply.

It is a further object to dispense with as many corners as possible to make the preferred embodiment easy to clean and without corners capable of trapping debris.

A further object of the invention to provide a simplified mouth wash and cup dispenser.

As a further object to provide mouth wash dispenser which promotes the use of large supply bottles and therefore lessens the environmental impact of multiple mouth wash bottles.

These and other objects and advantages of the invention will become better understood hereinafter from a consideration of the specification, with reference to the accompanying drawings forming a part thereof and in which like numerals correspond to like parts throughout the several views of the invention.

DETAILED DISCUSSION OF THE PREFERRED EMBODIMENT(S)

Figure 1:
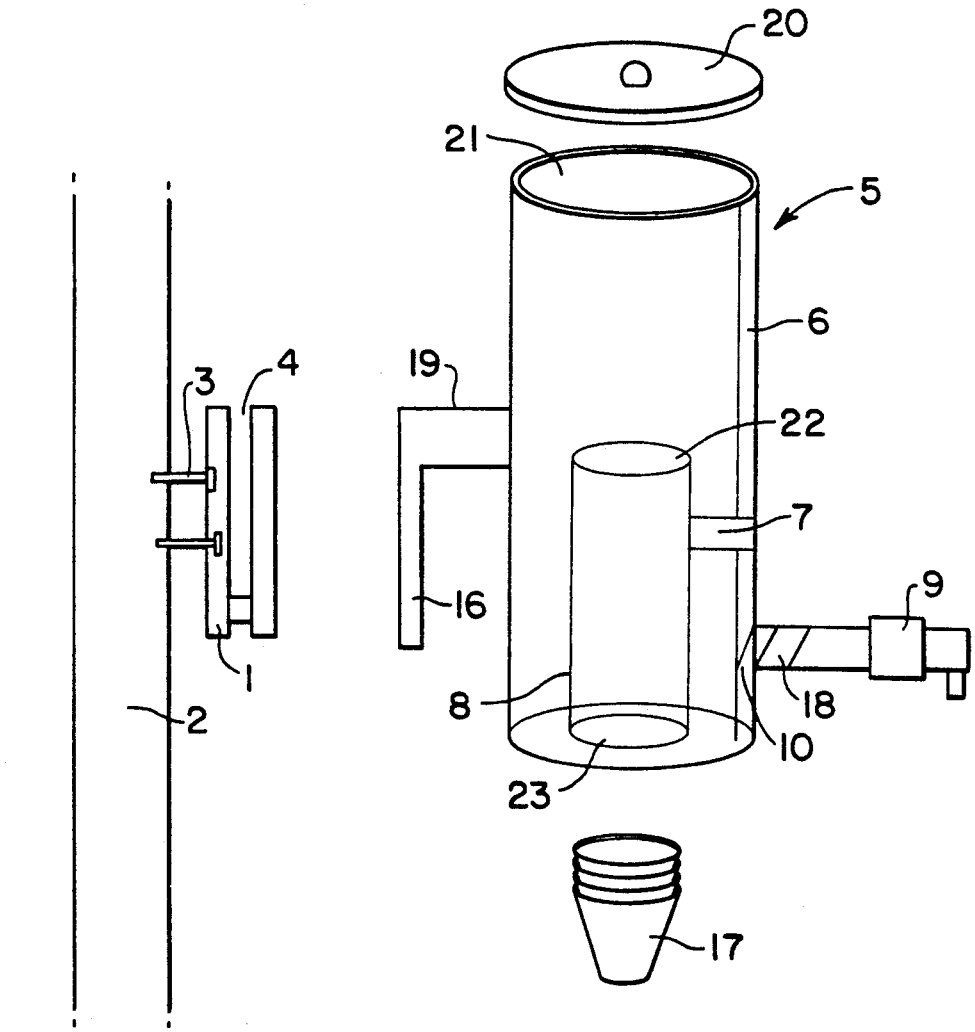
FIG. 1 is a perspective view of the invention.

As can best be seen from reference to FIG. 1 the invention set out herein comprises a bracket 1 attachable to a wall 2 by way of attachment means 3 which is shown as bolts 3. The bracket 1 may alternatively be glued in place or put in place otherwise with any attachment means known in the art. The bracket defines a slot 4 which in the preferred embodiment would pass through the entire center of the bracket 1 so as to allow foreign material such as dust to fall through.

A dispenser 5 has certain features in common with the prior art. These features include having an exterior cylinder 6 connected by way of one or more attachments 7 to a smaller central cylinder 8.

The interior cylinder 8 is designed to hold by friction or a small lip or ridges 24 at the bottom of the interior cylinder 8 a stack of cups 17 through an opening 23 defined in the bottom of the interior cylinder as is known in the art. The top 22 of the interior cylinder 8 is sealed to prevent leakage of the fluid contained in the exterior cylinder 6. The depth of the interior central cylinder 8 need not be great since the combination 5 defined by the exterior cylinder 6 and the interior cylinder 8 is designed for regular removal and replacement as is described in more detail below. This design is a major aspect of the inventive concept embodied herein.

The exterior cylinder 6 can hold mouthwash. This mouthwash can be extracted through a spigot 9 which is attached to the exterior cylinder 6 about a threaded opening 10 in the exterior cylinder 6. The purpose of this threaded opening 10 is to allow the more expensive spigot mechanism 9 to be cleaned and maintained. The spigot 9 may be made for cleaning utilizing sterilizing mechanisms common to hospitals.

Figure 2:
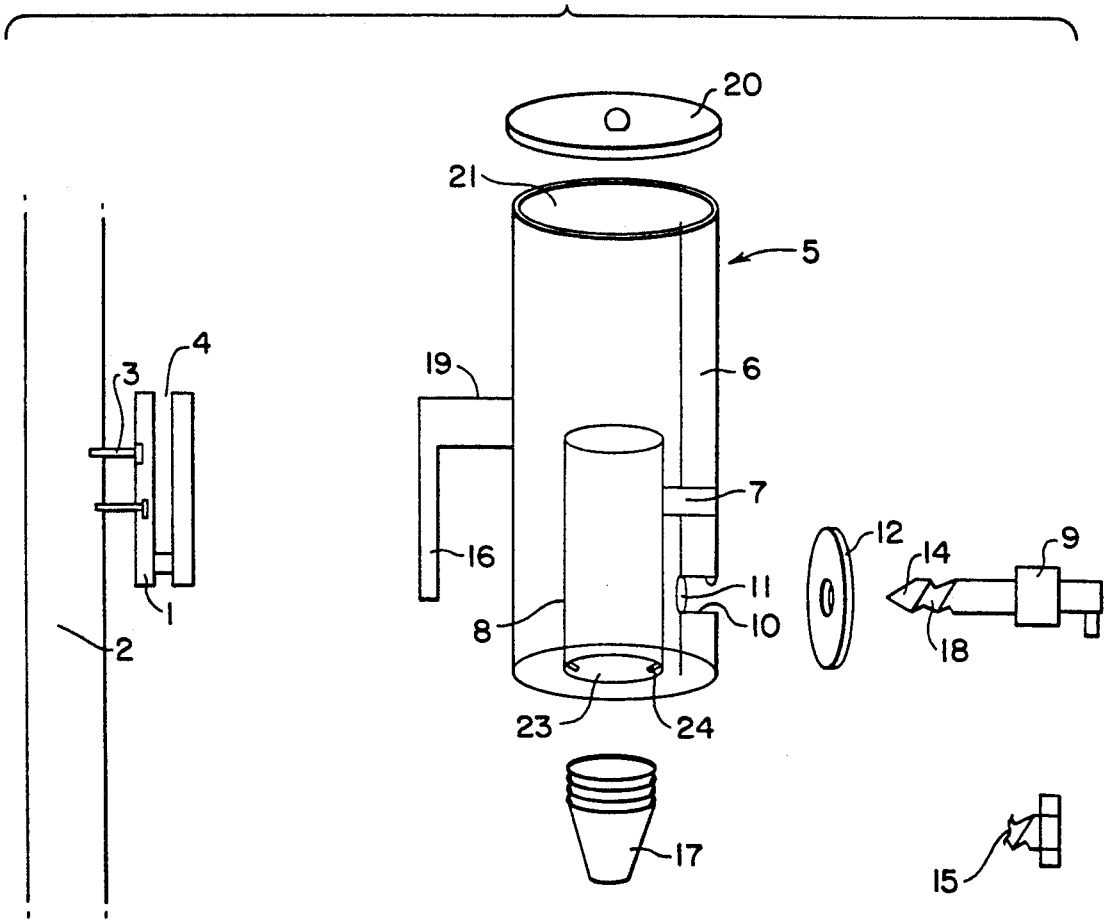
FIG. 2 is an exploded view of the dispensing portion of the invention shown in FIG. 1.

As can best be seen by reference to FIG. 2, in the preferred embodiment, the exterior cylinder threaded opening 10 is sealed with a breakable seal 11 which is broken when the spigot 9 is mounted. The threaded opening 10 and threads of the spigot 9 would preferably be teflon and closely matched to avoid the need for a washer. A washer 12 may be provided so that the washer is compressed and activated at the same point that the breakable seal 11 is contacted by the spigot 9.

The threads 18 of the spigot 9 may terminate in a pointed end 14 as shown in FIG. 2 which would serve to break the seal 11. Prior to placing the spigot in the threaded opening a cap 15 could be in place in the exterior cylinder to prevent contamination from getting into the threaded opening 10 and to prevent the seal 11 from being inadvertently punctured.

Referring again to FIG. 1 it can be seen that the exterior cylinder 6 is attached to a handle 16 which handle 16 extends downward. This handle 16 fits snugly within the slot 4 of bracket 1. In this way, once the bracket is mounted, it need never be removed. Instead, the exterior cylinders 6 are replaced or removed for cleaning as needed.

The handle 16 has an extension 19 which serves to offset the exterior cylinder 6 from the wall 2 and bracket 1 so that the exterior cylinder 6 can be more easily removed without contacting the wall 2 and so that the exterior cylinder may be refilled more easily. A cap 20 may be loosely fitted in place over a top opening 21 in the exterior cylinder 6 to allow the exterior cylinder 6 to be originally filled or refilled. A temporary sealing mechanism not shown can be used during shipping. Alternatively, if complete disposability is desired, the cap 20 may be permanently fixed in place so that the invention may be rendered leak free and not subject to spillage.

This design allows for the mouthwash and cup dispenser to be disposable or cleanable with easy replacement.

Because of the many varying and different embodiments which may be made within the scope of the inventive concept therein taught, and because many modifications may be made in the embodiments herein detailed in accordance with the descriptive requirements of the law, it is to be understood that the details herein are to be interpreted as illustrative and not in a limiting sense.

I claim:

1. A mouthwash dispenser comprising:

(a) an outer cylinder for holding mouthwash defining an opening near the bottom of said cylinder;

(b) a removable seal for sealing the opening and wherein said seal is piercable;

(c) a spigot replaceable for said seal within said opening for dispensing the mouthwash when the spigot defines a point for piercing the seal.

* * * * *